United States Patent [19]

Mochida

[11] Patent Number: 4,585,258

[45] Date of Patent: Apr. 29, 1986

[54] HOOD LOCKING APPARATUS

[75] Inventor: Haruo Mochida, Kanagawa, Japan

[73] Assignee: Nissan Motor Co., Ltd., Yokohama, Japan

[21] Appl. No.: 522,703

[22] Filed: Aug. 12, 1983

[30] Foreign Application Priority Data

Sep. 8, 1982 [JP] Japan ..... 57-157108

[51] Int. Cl.[4] ..... E05C 13/06

[52] U.S. Cl. ..... 292/125; 292/DIG. 14; 74/501 R

[58] Field of Search ..... 292/125, 171, 225, DIG. 14; 74/501

[56] References Cited

U.S. PATENT DOCUMENTS

| | | | |
|---|---|---|---|
| 2,749,165 | 6/1956 | Coulter | 292/DIG. 14 |
| 2,877,038 | 3/1959 | Kramer | 292/DIG. 14 |
| 2,924,473 | 2/1960 | Krause | 292/DIG. 14 |
| 2,975,653 | 3/1961 | Morse | 74/501 |
| 4,456,289 | 6/1984 | Baeliali | 292/DIG. 14 |

*Primary Examiner*—Richard E. Moore

*Attorney, Agent, or Firm*—Schwartz, Jeffery, Schwaab, Mack, Blumenthal & Evans

[57] ABSTRACT

The present invention relates to a hood locking apparatus for motor vehicles, and more particularly to a hood locking apparatus which is adapted to overcome any tendency for a remote control cable to disengage from a base plate of the locking mechanism. The locking apparatus uniquely comprises a reinforcing plate defined at the reverse side of a base plate to straddle mounting end portions defined at opposite ends of the base plate for attachment to the vehicle body and a cable disengagement preventive piece defined at and projected from the reinforcing plate to extend in the direction of a notch formed through the base plate. The reinforcing plate has its one end welded to the mounting end portions in such a manner that a predetermined clearance can be formed between the other end and one of the mounting end portions of the base plate. The cable disengagement preventive piece terminates short of an opening of a notch formed through the base plate with the reinforcing plate having its one end welded to the base plate, and closes the opening mentioned above when the other mounting end portion of the base plate is attached to the vehicle's body by means of a bolt together with the other end of the reinforcing plate.

7 Claims, 7 Drawing Figures

HOOD LOCKING APPARATUS

BACKGROUND OF THE INVENTION (1) Field of the Invention

The present invention relates to a hood locking apparatus for motor vehicles, and more particularly to a hood locking apparatus which is adapted to prevent a remote control cable from coming out of engagement with a base plate engaging portion of a locking mechanism.

(2) Description of the Prior Art

FIGS. 1–4 show a conventional commonly-used hood locking apparatus for motor vehicles, of the rear opening type, which comprises: a striker 2 centrally located on the bottom side and at the front edge of the vehicle's hood F, a locking mechanism 1 having a latch 4, disposed on the vehicle body B, and capable of being engaged and disengaged by the striker 2, and a remote control cable 8 connecting the latch 4 with an opening lever (not shown). The opening lever is operable from inside the vehicle for manually disengaging the latch 4 from the striker 2 upon pulling on the remote control cable 8, thereby causing a lever 5 of the locking mechanism 1 to lift and the striker 2 to flip upwards.

As shown in these figures, the locking mechanism 1 comprises a base plate 10 having mounting end portions 10*a* and 10*b* for attachment to the vehicle body, a latch 4 and the lift lever 5 which are both journaled to the base plate 10 by means of respective fixing pins 12 and 14. A spring 16 is provided between the latch 4 and the lift lever 5 for urging the latch 4 in a clockwise direction (as viewed in FIG. 2) on the one hand, and the lift lever 5 in a counterclockwise direction on the other hand to enable them to pinch and hold the striker 2 in a locked position upon the closure of the hood. The remote control cable 8 consists of a synthetic resin flexible outer tube 20 and a steel inner wire 22. The outer tube 20 is provided with a holder portion 24 at one end thereof so as to be engageable with a notch 10*d* defined at an elevational face 10*c* following the mounting end portion 10*a* of the base plate 10. The inner wire has its end 22*a* hooked to a curved upper end portion 4*a* of the latch 4.

Such a conventional hood locking apparatus, however, is disadvantageous in that the remote control cable 8 sometimes tends to come out of engagement with the base plate 10 as a result of a softened or worn holder portion 24 of the outer tube 20 due to hot air in the engine room or impact during repetitive engagement. In some arrangements, the outer tube 20, while the wire 22 is being pulled, moves to resume its original shape, or the inner wire 22 inclines with rotation of the latch 4, thereby applying a moment force on the holder portion 24 which facilitates disengagement of the holder portion 24.

In the event that the holder portion 24 is disengaged from the base plate 10, it would be no longer possible to open the hood F. Present, there is no immediate remedy available to the above especially with a rear opening type hood.

SUMMARY OF THE INVENTION

It is an object of the present invention to provide a hood locking apparatus which retains its locking function over a longer period.

It is a further object of the present invention to provide a hood locking apparatus which functions to positively prevent the holder portion from coming out of engagement with the base plate by providing a cable disengagement preventive piece. It is an object to eliminate the occurance of trouble where the hood of the vehicle can not be opened regardless of whether the holder portion is softened, or worn out due to hot air in the engine room, or irrespective of how the inner wire inclines to apply a tarning torque on the holder portion, which can facilitate a tendency for the holder portion to disengage.

Briefly described, these and other objects of the present invention are accomplished by the provision of hood locking apparatus comprising a reinforcing plate secured at the rear side of the base plate of the locking mechanism, and a cable disengagement preventive piece projected from the reinforcing plate, whereby the latter piece can prevent the remote control cable from coming out of engagement with the engagement portion of the base plate without impairing the operation of the locking mechanism and other structural components.

These and other objects and advantages of the present invention will be seen by reference to the description, taken in connection with the accompanying drawings.

DETAILED DESCRIPTION OF PREFERED EMBODIMENT

Figure 1:
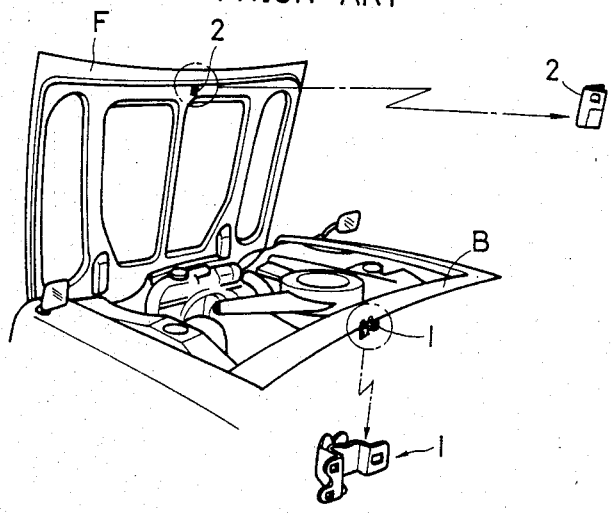
FIG. 1 PRIOR ART
FIG. 1 is a perspective view of a front portion of a prior art vehicle equipped with a hood locking apparatus.
Figure 2:
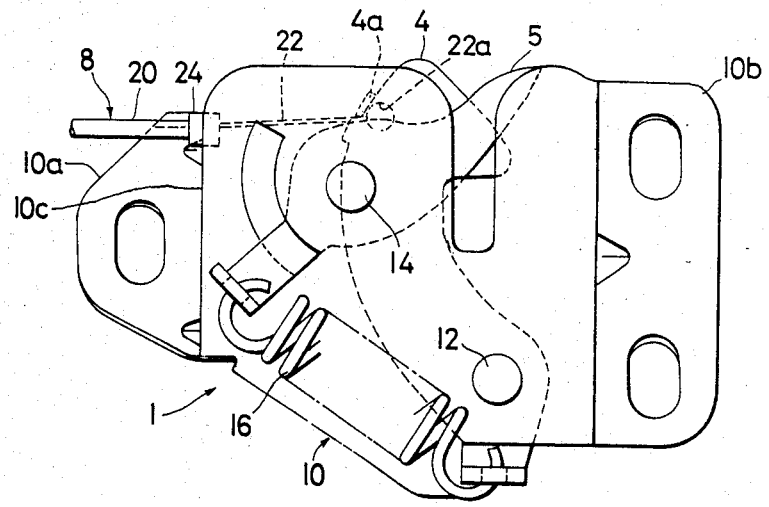
FIG. 2 PRIOR ART
FIG. 2 is a front view of a conventional hood locking mechanism.
Figure 3:
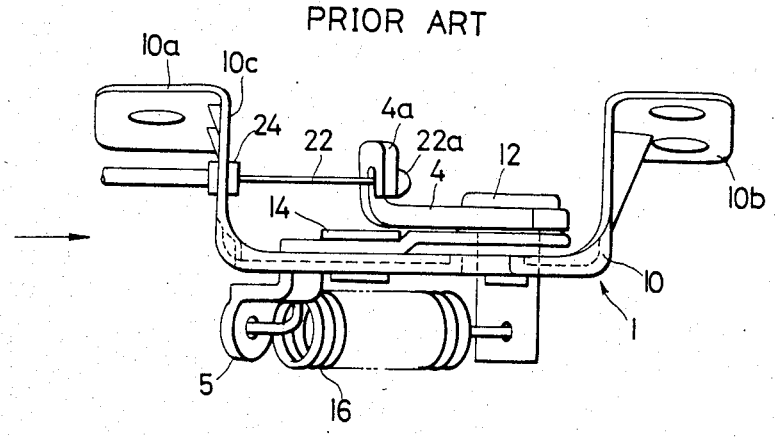
FIG. 3 PRIOR ART
FIG. 3 is a plan view of the same mechanism as in FIG. 2.
Figure 4:
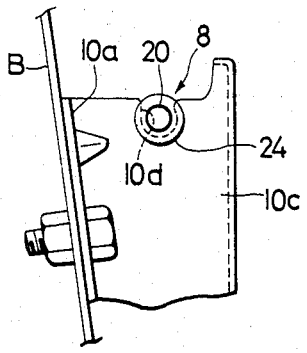
FIG. 4 PRIOR ART
FIG. 4 is a side view of essential parts of the mechanism in FIG. 3.
Figure 5:
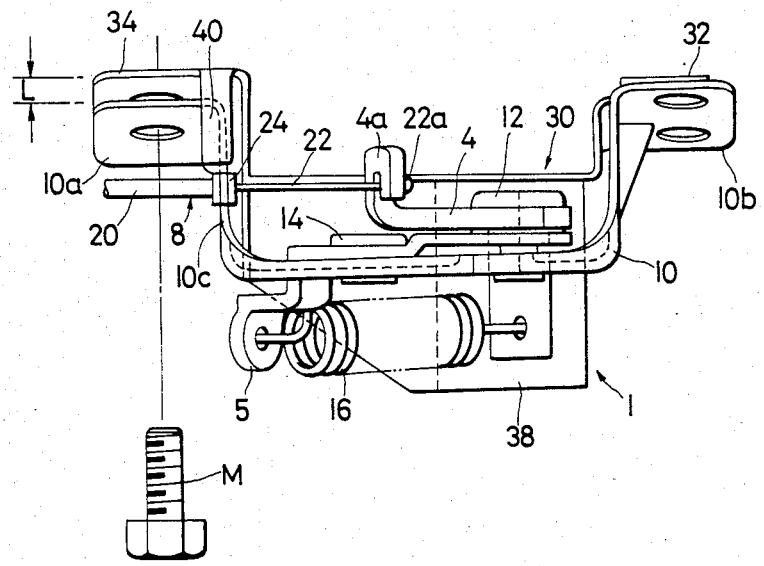
FIG. 5 is a plan view of a hood locking apparatus constructed in accordance with the present invention.
Figure 6:
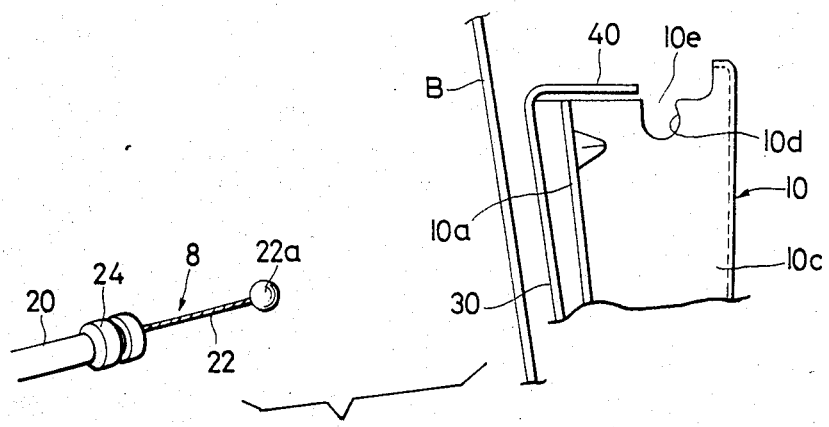
FIG. 6 is an exploded side view of essential parts of the locking mechanism in FIG. 5 prior to attachment to the vehicle body.
Figure 7:
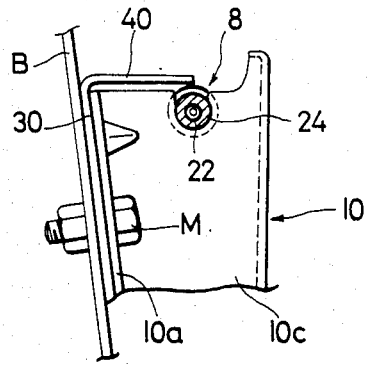
FIG. 7 is a view similar to FIG. 6, showing the locking mechanism as attached to the vehicle's body.

Referring now to FIGS. 5–7, there is shown a locking mechanism 1, constituting one part of the hood locking apparatus, and attached to the vehicle body B (see FIG. 1). The locking mechanism 1 may be provided for instance, on a hood lock bracket provided at a front face of a cowl top panel so as to be engaged and disengaged by the striker 2 provided on the hood F (see FIG. 1). The locking mechanism 1 comprises: a base plate 10 having mounting end portions 10*a* and 10*b* formed at the opposite ends thereof for attachment to the vehicle's body, a latch 4 and a lift lever 5 which are both journaled to the base plate 10 by means of respective fixing pins 12 and 14, and a spring 16 provided between the latch 4 and the lift lever 5, for biasing the latch and lift lever to pinch and hold the striker 2 in a locked position upon the closure of the hood. The remote control cable 8 consists of a synthetic resin flexible outer tube 20 and a steel inner wire 22. The outer tube 20 is provided with a holder portion 24 at one end thereof so as to be engageable with a notch 10*d* defined at a elevational face 10*c* following the mounting end portion 10*a* of the base plate 10. The inner wire 22 has its end 22*a* hooked to a curved upper end portion 4*a* of the latch 4.

The arrangement described above is entirely the same as that in the prior art.

Contrary to the conventional apparatus, the base plate 10 is provided with a reinforcing plate 30 defined at the rear side thereof (that is a side of vehicle body B) so as to straddle the mounting end portions 10*a* and 10*b*.

The reinforcing plate 30 has a first end 32 welded to the mounted end portion 10*b* of the base plate 10 in such a manner that a predetermined clearance L can be formed between a second end 34 and the mounting end portion 10*a* of the base plate 10 as shown in FIG. 5.

Moreover, the reinforcing plate 30 encloses the latch 4 and the lift lever 5 therein together with the base plate 10. The reinforcing plate 30 has a projection 38 formed therewith extending from a lower end portion thereof which forwardly extend over a spring 16. A cable disengagement preventive piece 40, integral with and projecting from an upper end of the second end 34, extends along a curved face 10*c* of the base plate 10 in the direction of a notch 10*d*. Although the cable disengagement preventive piece 40 terminates short of an opening 10*e* of the notch 10*d* as shown in FIG. 6 when the reinforcing plate 30 has its first end 32 welded to the base plate 10, it closes the opening 10*e* of the notch 10*d* as shown in FIG. 7 when the mounting end portion 10*a* of the base plate 10 and the second end 34 of the reinforcing plate 30 are attached to the vehicle body B.

This arrangement means that the holder portion 24 of the remote control cable 8 and one end 22*a* of the inner wire 22 are respectively secured in the notch 10*d* and to the upper end of the latch 4 prior to attachment of the locking mechanism 1 to the vehicle body B. The base plate 10 of the locking mechanism 1 is then attached to the vehicle body B together with the reinforcing plate 30 by means of the bolt M, thereby enabling the cable disengagement preventive piece 40 overlie and close the opening 10*e* of the notch 10*d*.

As can be readily appreciated from the foregoing description, the hood locking apparatus constructed in accordance with the present invention can, due to its cable disengagement preventive piece 40, positively prevent the remote control cable 8 from coming out of engagement with the base plate 10. The preventive piece functions regardless of whether the holder portion 24 thereof is softened, or worn out, due to hot air in the engine room and/or impact during repetitive engagement, or irrespective of how the inner wire 22 inclines to apply a turning torque on the holder portion 24 which can facilitate a tendency for the holder portion 24 to disengage. Malfunctions that would prevent the hood from opening are thus prevented.

Furthermore, the reinforcing plate 30 can, due to its box-like enclosure of the latch 4 and the lift lever 5 therein, provide increased rigidity adequate to oppose impacts of the striker 2 at the time of engagement and protects the contents therein from impairement.

In addition, the reinforcing late 30 can, due to its projection 38, effectively protect the latch 4, the lift lever 5 and the spring 16 from external forces which they may be subjected to in case of a vehicle collision.

This feature is especially desirable with the locking mechanism adopted in the rear opening type hood. The external forces mentioned above implies that impacts on the locking mechanism 1 by the engine or auxiliary components thereof which will be caused to move backwardly during impact at the time of a vehicle collision.

The hood locking apparatus constructed in accordance with the present invention, if adopted for the front opening type hood, displays a superior anti-pilferage function because the cable disengagement preventive piece 40 blocks any attempt to disengage the holder portion 24 from the base plate 10 by means of an improper tool, and then pulling the remote control cable 8 to finally release the locking mechanism 1. Thus operators need not worry about unauthorized unlocking of the hood.

As aforementioned, the hood locking apparatus emboding the present invention can positively prevent the remote control cable from coming out of engagement with the base plate, and consequently provides operators with an extremely reliable locking apparatus whereby the hood can be always opened without fail.

Although preferred embodiments of the invention are specifically illustrated and described herein, it will be appreciated that many modifications and variations of the present invention are possible in light of the above teachings and within the purview of the appended claims without departing from the spirit and intended scope of the invention.

What is claimed is:

1. A hood locking apparatus for locking a hood of a vehicle to a body of a vehicle, comprising:

a striker adapted to be fixed to the hood of the vehicle; and a locking mechanism for engaging the striker when the mechanism is fixed to the vehicle body, wherein the locking mechanism includes a base plate having first and second mounting ends for attaching to the vehicle body, and having a notch, a reinforcing plate disposed adjacent the base plate for disposition between the base plate and the vehicle body, having a first end welded to the first end of the base plate, and having a second end spaced from the second end of the base plate when the locking mechanism is not attached to the vehicle body, a remote control cable for disengaging the striker from the locking mechanism, having a first end and having a second end held in the notch of the base plate, a cable disengagement preventive piece integral with and projecting from an upper end of the second end of the reinforcing plate toward the notch in the base plate, and fastening means for fastening the second end of the base plate and the second end of the reinforcing plate to the vehicle body, wherein, when the second ends are fastened to the vehicle body, the second end of the base plate is no longer spaced from the second end of the reinforcing plate, and the preventive piece overlies the notch and secures the remote control cable in the notch.

2. A hood locking apparatus according to claim 1, wherein the locking mechanism further comprises:

a latch for engaging and disengaging said striker, and rotatably disposed on said base plate;

a lift lever for engaging and disengaging the striker, and rotatably disposed on the base plate;

a spring for biasing the latch in a first direction for engaging the striker, and for biasing the lift lever in a second direction, opposite the first direction, for engaging the striker, wherein the latch and the lift lever function to pinch and hold the striker in a locked position;

an opening lever attached to the first end of the control cable operable for manually disengaging the latch from the striker by moving the control cable;

a projection on said reinforcing plate for extending over the latch, the lift lever and the spring, and for protecting the locking mechanism from harmful impact with other vehicle parts during a vehicular collision.

3. A hood locking apparatus for locking a hood of a vehicle to a body of a vehicle, comprising:

a striker adapted to be fixed to the hood of the vehicle;

a locking mechanism for engaging the striker, including a base plate having first and second mounting ends for attaching to the vehicle body, a latch for engaging and disengaging the striker, and rotatably disposed on the base plate, a lift lever for engaging and disengaging the striker, and rotatably disposed on the base plate, a spring for biasing the latch in a first direction for engaging the striker, for biasing the lift lever in a second direction, opposite the first direction, and for engaging the striker, wherein the latch and the lift lever function to pinch and hold the striker in a locked position;

a remote control cable having a first end and a second end operatively connected to said latch, for disengaging the striker;

an opening lever attached to the first end of the control cable and operable for manually disengaging the latch from the striker by moving the control cable;

a reinforcing plate disposed adjacent the base plate for disposition between the base plate and the vehicle body, having a projection extending over the latch, the lift lever and the spring, and for protecting the locking mechanism from harmful impact with other vehicle parts during a vehicular collision.

4. A hood locking apparatus as claimed in claim 1 wherein said hood opens toward a back of the vehicle.

5. A hood locking apparatus as claimed in claim 1, wherein said hood opens toward a front of the vehicle.

6. A hood locking apparatus as claimed in claim 3, wherein said hood opens toward a back of the vehicle.

7. A hood locking apparatus as claimed in claim 3, wherein said hood opens toward a front of the vehicle.

* * * * *